United States Patent [19]

Berardi

[11] Patent Number: 4,753,147

[45] Date of Patent: Jun. 28, 1988

[54] GUITAR MUTE

[76] Inventor: Michael Berardi, 3827 Janice St., Philadelphia, Pa. 19114

[21] Appl. No.: 97,740

[22] Filed: Sep. 17, 1987

[51] Int. Cl.[4] ..... G10D 3/04

[52] U.S. Cl. ..... 84/453; 84/267; 84/318

[58] Field of Search ..... 84/267, 290, 310, 311, 84/318, 453

[56] References Cited

U.S. PATENT DOCUMENTS

| | | | |
|---|---|---|---|
| 3,440,917 | 4/1969 | Lemon | 84/267 |
| 3,956,962 | 5/1976 | Fields | 84/267 |
| 3,971,287 | 7/1976 | Ito | 84/453 |
| 4,116,107 | 9/1978 | Rickard | 84/267 |
| 4,509,399 | 4/1985 | McKibben | 84/216 |

*Primary Examiner*—Lawrence R. Franklin

[57] ABSTRACT

A guitar mute has a tubular body of elasticized terry-cloth. Hook and eye fasteners provide selectable tension on the strings when the mute is attached to the neck of the guitar. A felt pad sewn into the middle of the mute adapts to the contour of the fingerboard. Being slightly shorter than the distance between the two outermost strings, the felt pad, along with the elastic in the tubular body, provides an even pressure to all strings. The mute can be slid along the neck with one hand without removing the mute from the guitar.

14 Claims, 1 Drawing Sheet

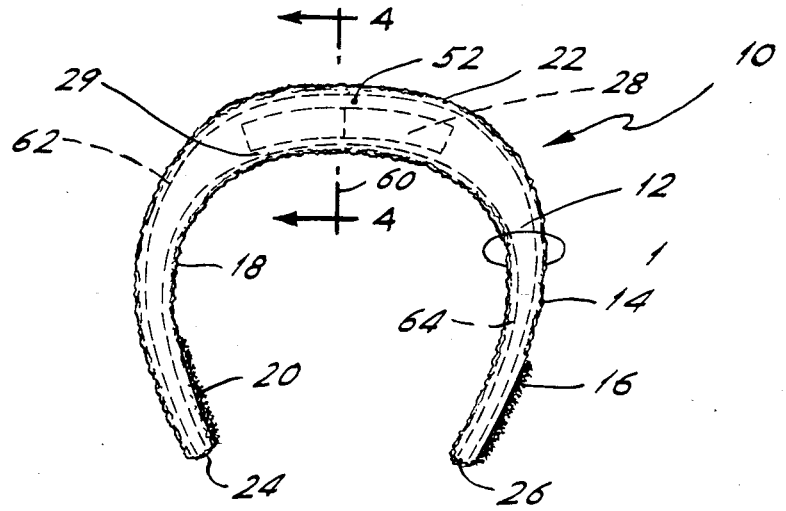
FIG. 1.
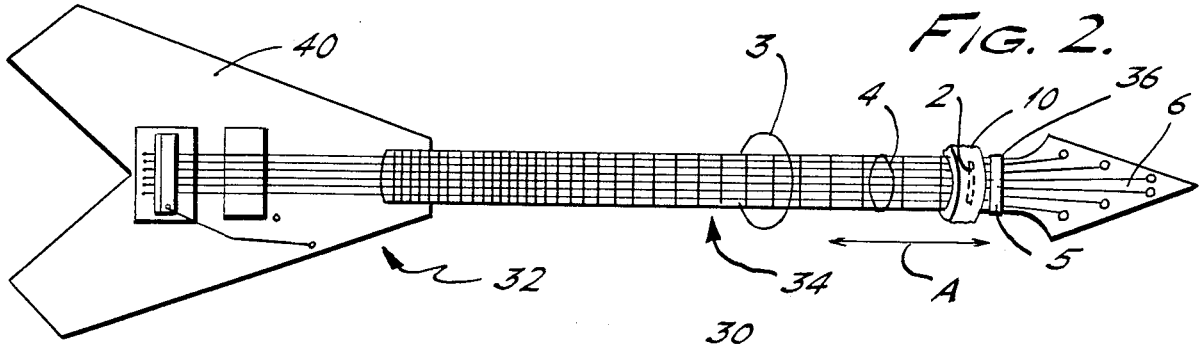
FIG. 2.
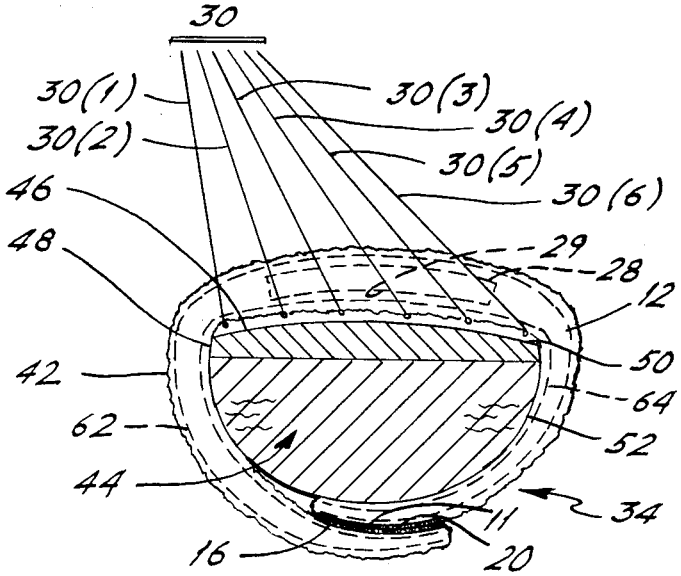
FIG. 3.
FIG. 4.
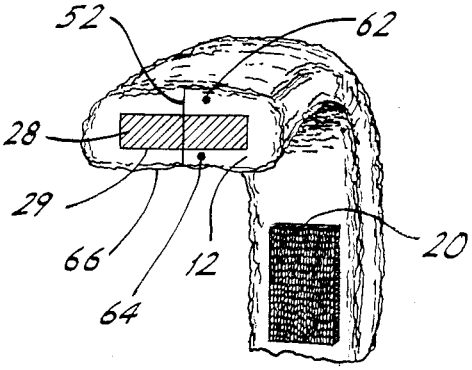

GUITAR MUTE

BACKGROUND OF THE INVENTION

1. Field of the Invention

This invention relates generally to stringed musical instruments and more specifically to a guitar mute for controlling extraneous string noise, harmonic overring, acousto-electronic feedback and sympathetic guitar string vibrations, all without altering the fundamental tone of the strings. The invention is also applicable to mandolins, banjos, ukuleles and to other stringed instruments such as basses, violins, violas, cellos and the like.

2. Description of the Prior Art

Known string dampers are mechanical attachments usually screwed into the head stock of the guitar or other instrument and which, through a spring-locking device, engage felt or a felt-like piece of material, putting the piece of material against the string to achieve limited damping of the string. Known damping devices do not permit varying degrees of damping; with known dampers typically only one, fixed amount of damping is available.

The known devices can be adjusted after removal from the guitar or other instrument to change the amount of damping provided but cannot be adjusted while the musician is playing the instrument to change the amount of damping while the musician is playing. These prior art devices are not quickly removable, quickly movable or quickly adjustable to permit the musician to vary the effect obtained during the performance.

An example of a known mechanical damper is a product sold under the trademark "Kleen-axe." This device includes a base, which may be fixed to the head stock, and a spring-loaded arm, pivotally fixed to the base, which rides against the strings in response to bias applied by the spring. A disadvantage of the Kleen-axe device is that when the device is applied to the strings to damp them during a performance, an unacceptable thudding sound is created, especially when using an amplified guitar, when the device is applied to the strings. Moreover, because of the metal construction of the Kleen-axe, additional harmonics are produced when the device is in place on the guitar. Yet another disadvantage of the Kleen-axe is that in order to activate and/or deactivate the device during a performance, the musician (or his assistant) must use two hands to position the Kleen-axe appropriately against the strings or to remove it from contact with the strings. This two-handed operation is disruptive to the musician's performance. As yet another disadvantage, the Kleen-axe requires adhesive to secure the device to the guitar; when the device is removed an ugly scar or adhesive mark remains.

Other known guitar mutes requires screw mounting with the screws being driven into the head stock or the body of the guitar. This is clearly undesirable.

Another prior art damper is a textile, yarn-like device provided as a stock accessory to the well-known "Chapman Stick" instrument. This damping device consists of fine denir yarns secured together with a backer and placed between the strings of the guitar and the fretboard, below the first fret. This device does not mute; it provides damping but the damping is not variable. The device does reduce extraneous string noise.

Of printed prior art known to applicant, U.S. Pat. No. 1,518,935 discloses a violin mute which fits under the strings of the violin, between the strings and the fingerboard at the body end of the neck. The U.S. Pat. No. 1,518,935 apparatus changes the fundamental tone of the violin when applied, because the apparatus fits between the two hands of the player, with one hand performing bowing and the other hand varying length of the strings, which changes pitch produced by a given string. This effect is acknowledged in the U.S. Pat. No. 1,518,935 specification, in the neighborhood of line 80, where the patentee notes that overtones may be eliminated at will using the U.S. Pat. No. 1,518,935 apparatus, thereby permitting the musician to obtain almost any desired tone from his violin.

Other printed prior art known to applicant includes U.S. Pat. No. 7,279 which discloses a guitar capo, which is a tuning adjustment device. The U.S. Pat. No. 7,279 apparatus effectively shortens all strings by the same amount. The U.S. Pat. No. 7,279 apparatus may be placed over the nut of the guitar, in a position of zero fret, thereby insuring that any loosening of the tuning screws does not result in a change of pitch of the guitar strings.

U.S. Pat. No. 3,647,930 discloses a capo device which adjusts to fit the curvature of the neck of a guitar. Other than recognition of the desirability of accommodating the curvature of the neck, U.S. Pat. No. 3,647,930 has no relevance to the invention disclosed herein.

A significant and recurring problem is the inability of existing synthesizer systems to quickly track ("track" meaning to follow or to reproduce) the digital representation of an audio signal produced by a guitar, where the digital representation of the audio signal is input to the synthesizer.

Today, music synthesizers are in widespread use. Typically, musicians use guitars to drive synthesizers with analog-to-digital conversion being required to convert the guitar tone signals from their analog form to digital form for input to an appropriate synthesizer which in turn generates the desired output signals, for example tones corresponding to a trumpet, flute or some other instrument. A continuing problem in using guitars to drive synthesizers is the inability of known analog-to-digital converters to acceptably process the typical multi-colored or multi-hued tone produced by a guitar, due to the inherent characteristic whereby a guitar produces not only fundamental tones but also many harmonics associated with given fundamentals. Further creating difficulty for the analog-to-digital conversion circuitry, when a guitar is used as the driver to produce the analog signal, is the fact that guitars, due to their characteristic construction whereby six strings are adjacent one to another, necessarily produce sympathetic vibration of adjacent strings when one string is plucked. Heretofore, such sympathetic vibration and consequent difficulties for the analog-to-digital converter circuitry could not be avoided when using a guitar as the driver for a music synthesizer. The same problem occurs when any stringed instrument is used to drive a music synthesizer—sympathetic vibrations are inherent.

OBJECTS OF THE INVENTION

An important object of this invention is to provide a string damper-mute providing a selectable, fixed degree of damping and selectable, fixed muting to all strings regardless of the location on the guitar neck where the mute is positioned, which compensates for the curvature of the neck of the guitar as the mute is moved along the guitar neck.

A further object of this invention is to provide such a string damper-mute which facilitates adjustment of damping and muting with relative ease.

It is a further object of this invention to provide a damper-mute device which controls extraneous string noise, harmonic overring, acousto-electronic feedback and sympathetic string vibrations without altering the fundamental tones of the strings.

It is a further object of the invention to provide a guitar damping and muting device which can be moved along the neck of the guitar with the same motion as the fingering hand or hands, as those hand or hands are moved along the guitar neck.

Yet another object of this invention is to provide a variable damper-mute device which is simple in construction, easily applied to the instrument without modification of the instrument and which can be marketed and sold at an affordable price.

SUMMARY OF THE INVENTION

The invention provides a stringed instrument mute which controls extraneous string noise, harmonic overring, acoustic-electronic feedback and sympathetic string vibrations without altering the fundamental tones of the strings. As a result, the notes played by the artist when utilizing the invention are purer, cleaner and create a more distinct musical passage. The invention works well in both acoustic (non-amplified) and electric guitars.

The invention facilities use of conventional guitars to produce input driver signals to music synthesizer systems by purifying the tone produced by the guitar. Specifically, the invention reduces sympathetic string vibrations and helps the guitar create a purer fundamental tone without harmonic overring. The resultant purer tone, when provided as input to a music synthesizer, is more easily processed by the analog-to digital-conversion circuitry thereby permitting the synthesizer system to provide a more pleasant effect to the listener.

The guitar mute of the invention can be moved along the neck towards the head stock or towards the body with relative ease and without noticeable extraneous sounds. Hence, the guitar mute of the invention does not interfere with but rather helps to accent appropriate musical passages played by the musician.

In one aspect of the invention there is provided an adjustable, self-compensating transitory guitar mute for damping extraneous string noise, harmonic overring, acousto-electric feedback and sympathetic string vibrations without altering the string fundamental tones, which is adjustable by the musician while performing using a single hand and which includes a longitudinally elongated flexible tubularly-woven fabric having longitudinally extending elastic filaments along at least the major portion of the longitudinal length of the fabric from a central position and being substantially uniformly circumferentially spaced therethroughout. The mute further includes a releasable flexible fabric grasping means at respective ends of the tubularly woven fabric, including hook and eye portions of familar Velcro-type construction, with the hook portion being in a first end of the fabric and adapted to releasably engage the eye portion of the grasping means when pressed thereagainst. The eye portion is at a remaining end of the fabric from the hook portion. The hook and eye portion face diametrically oppositely with respect to the axis of the tubularly woven fabric so that when the tubular fabric is substantially toroidally configured, with the fabric longitudinal axis formed generally circularly and with the tubular fabric ends proximate one another, the hook portions may be pressed against the eye portions to retain the tubularly woven fabric in the substantially toroidal configuration. The mute further includes a longitudinally elongated semi-rigid pad for distributing muting force over the strings of the guitar when the mute is configured about the neck of the guitar. The pad is positioned within the tubularly woven fabric proximate the center of the fabric and extends longitudinally a length less than minimum distance between the outermost string of the guitar at junction of the guitar body and the guitar neck. The pad is preferably felt and the woven fabric is preferably elasticized terry.

DESCRIPTION OF THE DRAWINGS

FIG. 1 is a front elevation of a guitar mute embodying the invention.

FIG. 2 is a front view of a guitar having a guitar mute embodying the invention installed thereon.

FIG. 3 is a sectional view of the neck of the guitar illustrated in FIG. 2, taken in the general vicinity of arrow 3 in FIG. 2, illustrating the neck of the guitar in FIG. 2 with the guitar mute of the invention installed thereon.

FIG. 4 is a sectional view of the guitar mute invention taken at lines and arrows 4—4 in FIG. 1.

DESCRIPTION OF THE PREFERRED EMBODIMENT AND BEST MODE KNOWN FOR PRACTICING THE INVENTION

The guitar mute of the invention is disclosed generally in FIG. 1 and is designated generally 10. Guitar mute 10 includes a generally tubular, preferably tubularly woven, axially elongated outer sleeve-like fabric member 12, which is preferably elasticized so as to be resiliently stretchable in the longitudinal direction, adapted to be secured around the guitar neck as illustrated in FIG. 3. Secured to one generally curved outwardly facing exterior surface, designated 14 in FIG. 1, of tubular member 12 is a first securing device, which is preferably the eye component of a Velcro closure, designated generally 16 in FIG. 1. While the mute of the invention has been illustrated in FIG. 1 in generally horseshoe-shaped configuration, the normal configuration of the mute of the invention, prior to being installed in place on the guitar neck, is generally straight, with the tubular axially elongated outer sleeve-like member 12 extending in a relatively straight line. Generally tubular, axially elongated outer sleeve-like member 12 preferably tapers slightly from larger diameter at its longitudinal midpoint, indicated by numeral 60 in FIG. 1 to lesser diameter at extremities 24, 26.

While outer sleeve member 12 is described as being "tubular", this is a relative term and due to the soft, flexible fabric construction of outer sleeve member 12, this member rarely presents a true circular cross-section in practice.

Secured to a second generally curved outwardly facing exterior surface 18 of tubular sleeve-like fabric member 12, where first and second surfaces 14, 18 are both on the curved exterior of tubular sleeve member 12 with surface 18 facing generally diametrically oppositely to first surface 14, is a second securing device designated generally 20, which is preferably the hook portion of a Velcro closure. First and second securing devices 16, 18 are not only affixed to opposite sides 14, 18 of tubular sleeve member 12 but are affixed to such opposite sides at opposite longitudinal extremities of tubular outer sleeve member 12, proximate respective extremities 24, 26.

Secured within central portion 22 of tubular outer sleeve member 12 is a somewhat flexible generally rectangular solid member, best illustrated in FIG. 4, which has been designated generally 28 in the drawings and which distributes force generally uniformly to the strings of the guitar when the guitar damper-mute of the invention is positioned about the guitar neck. Rectangular member 28 is preferably felt and, when initially installed in sleeve member 12, is preferably of generally rectangular solid configuration having a surface 29, facing the strings of the guitar when the mute is in place, which is essentially flat.

As the mute of the invention is used, the semi-rigid but somewhat flexible character of felt member 28 permits member 28 gradually to bow and assume the configuration illustrated in FIG. 1 where surface 29, which faces the strings when the mute is in position on the guitar neck, becomes somewhat concave, as illustrated. The force distribution pad 28 is preferably secured within tubular outer sleeve member 12 via stitching 52, shown schematically in FIG. 1. Stitching 52 preferably extends through rectangular felt member 28 at the midpoint thereof but does not extend any significant distance along the longitudinal length either of rectangular member 28 or tubular outer sleeve member 12. This construction permits the lateral extremities of rectangular member 28 to be free-floating with respect to the surrounding portion of tubular outer sleeve member 12 thereby permitting rectangular member 28 to adapt itself to the curvature of the fretboard of the guitar.

In FIG. 2, the guitar mute of the invention designated generally 10 is illustrated in position on a guitar 32. Mute 10 is positioned about the guitar neck 44 and is movable back and forth along the neck, as indicated by arrow A in FIG. 2, by the musician brushing mute 10 with the musician's hand while performing. The musician can select a desired degree of damping of the strings by varying the position at which hook and eye members 20, 16 engage one another thereby tightening or loosening the guitar mute as it is positioned about neck 44. Guitar mute 10 is movable along strings 30 along the entire length of guitar neck assembly 34, from juncture of neck assembly 34 with the guitar body 40 to the guitar nut designated generally 36 in FIG. 2.

Tubular outer sleeve member 12 is preferably terrycloth, particularly elasticized cotton or terrycloth, constructed like a conventional sock or athletic wristband. This construction of tubular outer sleeve member 12 provides a relatively smooth exterior surface so that outer sleeve member 12 does not entangle or snag the strings, frets or nut when the damper-mute is moved along the strings, towards either the guitar body or the guitar head stock.

While tubular outer sleeve member 12 is illustrated as being of generally circular cross-section in the area designated by circle 1 in FIG. 1, in practice, tubular outer sleeve member 12, in the areas removed from central portion 22, is essentially collapsed, without any interior volume being provided.

In one preferred embodiment of the invention, the tubular outer sleeve member has been elastric stretch terrycloth. The force applying and distributing member 28 has been felt, of generally rectangular solid configuration, having dimensions about one and three-eighths inches in length, five-eighths inches in width and one-quarter inch thick.

Flexible pressure applying member 28 serves to curvature-compensate the damper-mute 10 in the area over the strings of the guitar, when the damper-mute is placed in position as illustrated in FIGS. 2 and 3. As best illustrated in FIG. 3, when the damper-mute is positioned on the guitar neck, the flexible, initially planar pressure applying member 28 is positioned over the strings 30 of the guitar which is designated generally 32 in FIG. 2.

Securing devices 16 and 20 are preferably commercially available Velcro and are preferably sewn to the respective ends of outer sleeve member 12. Conventional sewing stitches may be used.

While the two securing members or devices 16 and 20 illustrated in FIG. 1 have been shown as being of approximately the same size in FIG. 1, it may be desirable to provide one portion of the Velcro somewhat longer than the remaining portion, to permit the guitar damper-mute of the invention to be used on and in connection with guitar necks of varying size. Also, depending upon the gauge of the strings used on a given guitar, it may be desirable to use greater or reduced force against the strings; having differing lengths of the two securing devices 16, 20 facilitates such adjustment of the damper-mute of the invention.

To adjust the damping and muting provided by the invention, the musician may slide the guitar damper-mute 10 along guitar neck 34 over guitar nut 36, towards guitar head stock 38, in the direction indicated by arrow A in FIG. 2. Alternatively, if the artist desires to increase the damping and muting provided by the damper-mute of the invention, the musician slides the guitar damper-mute to the left in FIG. 2, over guitar neck 34 towards guitar body 40.

Referring to FIG. 3, the damper-mute of the invention is positioned around guitar neck 34 with securing devices 16, 20 in locking engagement with one another so that the elastic tubular outer sleeve member 12 is slightly stretched due to the relative positioning of securing devices 16, 20 respecting one another. As shown in FIG. 3, the male or hook portion of Velcro, defining second securing device 20, is preferably on the outer or overlapping extremity 24 of tubular outer sleeve member 12 while the female or eye portion of Velcro, defining securing device 16, is preferably on the underlapping or second longitudinal extremity of outer sleeve member 12. If this construction is not provided and if the respective securing devices were reversed, extremity 26 of tubular outer sleeve member 12 would be loose, free-hanging and could be snagged by the guitar player's hand, thereby causing the damper-mute of the invention to disengage the guitar neck during a performance. This would, of course, be undesirable.

Referring to FIG. 3, in a conventional guitar the guitar neck assembly is designated generally 34 and includes a fretboard 42 bonded, usually by gluing, to a neck 44. The outwardly facing surface 52 of neck 44 is curved to accommodate and to facilitate the musician's hand moving along the neck.

The surface of fretboard 42, designated generally 46 in FIG. 3 is convexly curved as illustrated therein. First and second margins of fretboard 42 are designated 48, 50 and are defined by juncture of fretboard outwardly facing convex surface 46 and the fretboard side surfaces, which are unnumbered in FIG. 3. Conventionally, the segment of fretboard surface 46 illustrated in FIG. 3 defines a circular arc of between about 10 and about 25 degrees.

The width of neck 44 and fretboard 42 varies from narrower at the head stock end of the guitar neck assembly 34, which is the right-hand end of the guitar as illustrated in FIG. 2, to wider at the body end of the guitar neck assembly 34, which is the left-hand end of the guitar illustrated in FIG. 2.

Typically, the arc defined by fretboard surface 46 becomes flatter as one moves from the head stock end of the guitar neck assembly to the body end of the guitar neck assembly.

Tubular outer sleeve member 12 preferably has longitudinally extendable elastic filaments running at least the major portion of the longitudinal length of sleeve member 12 from the central portion of sleeve member 12 with the elastic filaments preferably being substantially uniformly circumferentially spaced throughout sleeve member 12. Two of such filaments are illustrated in dotted lines in FIG. 1 and in solid lines in FIGS. 3 and 4 and are designated 62 and 64 respectively. These elastic filaments 62, 64 provide the automatic compensating feature of the invention as the guitar mute is moved along the guitar neck assembly in the direction as indicated by arrow A in FIG. 2.

From FIG. 3 it is apparent that the neck assembly 34 has a curvature associated with outwardly facing surface 46 of fretboard 42. Similarly, there is a curvature associated with the outwardly facing surface of guitar neck 44, as illustrated in FIG. 3. Moreover, the neck assembly narrows as one proceeds from the body end of the neck assembly towards the head stock end of the neck assembly. At the head stock end, where the fretboard and neck are narrower and both have greater curvature (relative to curvature of the fretboard and neck at juncture of the guitar body) the elastic filaments 62, 64, when the guitar mute is at the position adjacent the guitar nut, on the neck assembly as illustrated in FIG. 2, urge the surface portion 66 of tubular member 12 which contacts strings 30 against the strings thereby providing the muting and damping effects.

As illustrated in FIG. 3, elastic filament 62 is stretched to a greater degree than is elastic filament 64 when the guitar mute of the invention is installed about the neck assembly. This is because elastic filament 62, being outboard of filament 64 in FIG. 3, is elongated to a greater extent than filament 64. As a result, filament 62 provides greater radially inward force, acting towards the center of the cross-section of the guitar neck assembly 34 illustrated in FIG. 3, than does filament 64. Filament 64 tends to urge surface 66, which contacts strings 30 into greater contact with strings 30. Filament 62 in turn applies force to pad member 28, tending to urge pad member 28 towards fretboard 42. This action of pad 28 serves to apply additional damping force to the portions of surface 66 of tubular outer sleeve member 12 contacting strings 30 which are inboard of the outermost strings, specifically strings 30(2) 30(3), 30(4) and 30(5). This is necessary because the location of outboard strings 30(1) and 30(6), proximate the edge of fretboard 42, results in force applied by filament 64 to be substantially greater on strings 30(1) and 30(6) than applied to the remaining, interior strings. Hence, the effect of filament 62 and pad 28 is to apply additional damping force to the interior strings thereby creating substantially uniform force applied to all of the strings by the guitar mute of the invention.

As the head stock end of the guitar neck assembly where fretboard 42 is narrower and has greater curvature, the elastic filaments 62, 64 and particularly filament 62 apply less force to the strings and specifically elastic filament 62 applies less force to pressure distribution pad 28, than is applied when the guitar mute is at the body end of the neck assembly, because the width of the fretboard is less at the head stock end than at the body end. As the mute is advanced from the head stock end towards the guitar body, width of the fretboard increases while curvature of the fretboard decreases. The increase in width of the fretboard causes filament 62 to stretch more and more as the mute is moved towards the body end of the guitar neck assembly. Accordingly, filament 62 applies greater and greater force to pressure distribution pad 28 thereby resulting in greater force being applied against the strings. This is desirable because curvature of the guitar neck assembly decreases as one proceeds from the head stock end to the body end of the neck assembly. Hence, were it not for the increase in width of the guitar neck assembly (including the fretboard) the muting effect would decrease due to the decrease in curvature of the neck assembly as the mute is moved from the head stock end to the body end of the neck assembly.

What is claimed is:

1. A guitar mute, comprising:

a. a longitudinally elongated flexible tubular fabric tube having longitudinally extendible elastic members running the longitudinal length thereof;

b. releasable grasping means at respective ends of said tube including hook and eye portions of said grasping means with said hook portion of said grasping means being at a first end of said tube and adapted to releasably engage said eye portion of said grasping means when pressed thereagainst, said eye portion being at a remaining end of said tube, said hook and eye portions facing diametrically oppositely with respect to the axis of said tube so that when said tube is configured generally circularly with the tube ends proximate one another, said hook portions may be pressed against said eye portions to retain said tube in said generally circular configuration;

c. a longitudinally elongated semi-rigid pad member for distributing muting force over the strings of said guitar when said mute is configured about the neck of the guitar, positioned within said fabric tube proximate the center thereof, extending longitudinally a length less than the minimum distance between outer most strings of said guitar at juncture of said guitar body and said guitar neck.

2. An adjustable self-compensating, stringed musical instrument transitory mute for damping extraneous string noise, harmonic overring, acousto-electric feedback and sympathetic string vibrations without altering the string fundamental tones, adjustable by the musician, while performing, using single hand, comprising:

a. an elongated longitudinally extendible elastic member;

b. releasable grasping means proximate at least one end of said elastic member, being adapted to releasably engage a remaining end of said elastic member to configure said elastic member generally circularly about the a neck of said stringed musical instrument;

c. a longitudinally elongated semi-rigid pad member for distributing muting force over the strings of said instrument when said mute is circularly configured about the neck of the instrument, secured to said elastic member proximate the center thereof, extending longitudinally along said elastic member and having a length at a surface thereof facing oppositely from said elastic member substantially the minimum distance between outer-most strings of said instrument at juncture of instrument body and neck and including a fabric portion at said surface facing oppositely from said elastic member for mutingly contacting said strings of said instrument when said mute is circularly configured about said neck of said instrument.

3. An adjustable self-compensating, transitory guitar mute for damping extraneous string noise, harmonic overring, acousto-electric feedback and sympathetic string vibrations without altering the string fundamental tones, adjustable by the musician, while performing, using single hand, comprising:

a. a longitudinally elongated flexible tubularly woven fabric having longitudinally extendible elastic filaments running at least a major portion of the longitudinal length thereof from a central position and being substantially uniformly circumferentially spaced therethroughout;

b. releasable flexible fabric grasping means at respective ends of said tubularly woven fabric including hook and eye portions with said hook portion being at a first end of said fabric and adapted to releasably engage said eye portion of said grasping means when pressed thereagainst, said eye portion being at a remaining end of said fabric, said hook and eye portions facing diametrically oppositely with respect to the axis of said tubularly woven fabric so that when said tubular fabric is substantially torodially configured with its longitudinal axis formed generally circularly with the tubular fabric ends proximate one another, said hook portions may be pressed against said eye portions to retain said tubularly woven fabric in said substantially torodoidal configuration;

c. a longitudinally elongated semi-rigid pad for distributing muting force over the strings of said guitar when said mute is configured about the neck of the guitar, positioned within said tubularly woven fabric proximate the center thereof, extending longitudinally a length less than the minimum distance between outer most strings of said guitar at juncture of said guitar body and said guitar neck.

4. The guitar mute of claim 3 wherein said hook and eye portions of said grasping means are of different lengths in said longitudinal direction.

5. The guitar mute of claim 4 wherein said fabric is terry.

6. The guitar mute of claim 5 wherein said pad is felt.

7. The guitar mute of claim 6 wherein said pad is of generally rectangular-solid configuration.

8. The guitar mute of claim 7 wherein said pad is secured to said fabric by stitching proximate the center of the pad.

9. The guitar mute of claim 8 wherein said tubularly woven fabric tapers from larger diameter at its longitudinal midpoint to lesser diameter at its extremities.

10. The guitar mute of claim 3 wherein said fabric is terry.

11. The guitar mute of claim 3 wherein said pad is felt.

12. The guitar mute of claim 3 wherein said pad is of generally rectangular-solid configuration.

13. The guitar mute of claim 3 wherein said pad is secured to said fabric by stitching proximate the center of the pad.

14. The guitar mute of claim 3 wherein said tubularly woven fabric tapers from larger diameter at its longitudinal midpoint to lesser diameter at its extremities.

* * * * *